US011970844B2

(12) United States Patent
Bjerke et al.

(10) Patent No.: US 11,970,844 B2
(45) Date of Patent: Apr. 30, 2024

(54) CORNER SEGMENT AND CORNER SHROUD HAVING A CURVED PORTION FOR A WORK IMPLEMENT

(71) Applicant: Caterpillar Inc., Peoria, IL (US)

(72) Inventors: Nathan R Bjerke, Peoria, IL (US); Thomas M. Congdon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 202 days.

(21) Appl. No.: 17/212,015

(22) Filed: Mar. 25, 2021

(65) Prior Publication Data

US 2021/0332568 A1 Oct. 28, 2021

Related U.S. Application Data

(60) Provisional application No. 63/015,928, filed on Apr. 27, 2020.

(51) Int. Cl.

| | |
|---|---|
| ***E02F 9/28*** | (2006.01) |
| ***E02F 3/40*** | (2006.01) |
| ***E02F 3/815*** | (2006.01) |

(52) U.S. Cl.

CPC ..... *E02F 9/2883* (2013.01); *E02F 3/40* (2013.01); *E02F 3/8152* (2013.01); *E02F 3/8157* (2013.01); *E02F 9/28* (2013.01); *E02F 9/2858* (2013.01)

(58) Field of Classification Search

CPC ..... E02F 9/2883; E02F 9/28; E02F 9/2858

See application file for complete search history.

(56) References Cited

U.S. PATENT DOCUMENTS

| | | | | |
|---|---|---|---|---|
| 3,736,675 | A | 6/1973 | Shankwitz et al. | |
| 4,047,312 | A | 9/1977 | Stepe | |
| 4,776,113 | A * | 10/1988 | Bedford | E02F 9/2841 172/701.2 |
| 8,464,443 | B2 | 6/2013 | Torgrimsen | |

(Continued)

FOREIGN PATENT DOCUMENTS

| | | | |
|---|---|---|---|
| AU | 2015100869 A4 | 7/2015 | |
| CA | 2827089 A1 * | 3/2014 | E02F 9/2816 |

(Continued)

OTHER PUBLICATIONS

Japanese Notice of Rejection for Japan Patent Appln. No. 2022-563453, dated Oct. 3, 2023 (5 pgs) with English Translation (5 pgs).

*Primary Examiner* — Adam J Behrens
*Assistant Examiner* — Blake E Scoville

(57) ABSTRACT

In one aspect, a corner shroud includes a body that may have a floor portion having a floor rear surface, a floor inner surface, a floor lower surface, and a floor upper surface having a curved portion, a side portion, extending from the floor portion, and having a side outer surface, a side rear surface, a side inner surface, and a side upper surface, a front portion extending between the floor portion and the side portion, the front portion having a front surface, a front inner surface, and a front rear surface, and a top portion extending from the front portion, the top portion having a top upper surface, a top inner surface, a top lower surface, a top rear surface, and a top outer surface. The floor upper surface, the side inner surface, the front rear surface, the top lower surface, and the top inner surface define a recess.

18 Claims, 6 Drawing Sheets

(56) References Cited

U.S. PATENT DOCUMENTS

| | | | | |
|---|---|---|---|---|
| 9,593,470 | B2 | 3/2017 | Dallard et al. | |
| 2014/0059900 | A1 | 3/2014 | Tanaka et al. | |
| 2014/0360060 | A1 | 12/2014 | Kunz | |
| 2016/0362874 | A1* | 12/2016 | Hooijmans | E02F 3/48 |
| 2016/0362875 | A1 | 12/2016 | Attwood | |
| 2017/0314236 | A1 | 11/2017 | Long et al. | |
| 2017/0328038 | A1* | 11/2017 | Campomanes | E02F 9/2883 |
| 2019/0063043 | A1 | 2/2019 | Balan et al. | |
| 2019/0063045 | A1 | 2/2019 | Balan et al. | |
| 2020/0157779 | A1* | 5/2020 | Sinn | E02F 9/2808 |

FOREIGN PATENT DOCUMENTS

| | | | | |
|---|---|---|---|---|
| CL | 2012002249 | | 6/2013 | |
| CN | 105452572 | | 3/2016 | |
| CN | 107923156 | | 4/2018 | |
| CN | 109477327 | | 3/2019 | |
| CN | 110073062 | | 7/2019 | |
| CN | 110073063 | | 7/2019 | |
| CN | 111051621 | | 4/2020 | |
| EP | 3470585 | B1 | 11/2019 | |
| GB | 1272955 | A * | 5/1972 | |
| JP | S5736711 | | 9/1977 | |
| JP | S5338101 | | 4/1978 | |
| JP | S5393603 | | 7/1978 | |
| JP | 2006525450 | | 11/2006 | |
| JP | 4491111 | B2 | 6/2010 | |
| WO | WO-8102318 | A1 * | 8/1981 | |
| WO | WO-2007016719 | A1 * | 2/2007 | E02F 9/2825 |
| WO | WO-2013067585 | A1 * | 5/2013 | E02F 9/2883 |
| WO | 2014037781 | | 3/2014 | |
| WO | WO-2014037781 | A2 * | 3/2014 | E02F 3/40 |
| WO | 2017075663 | A1 | 5/2017 | |
| WO | WO-2017075663 | A1 * | 5/2017 | |

* cited by examiner

CORNER SEGMENT AND CORNER SHROUD HAVING A CURVED PORTION FOR A WORK IMPLEMENT

CROSS-REFERENCE TO RELATED APPLICATION(S)

This application claims the benefit of priority under 35 U.S.C. § 119 to U.S. Provisional Patent Application No. 63/015,928, filed on Apr. 27, 2020, the entirety of which is incorporated herein by reference.

TECHNICAL FIELD

The present disclosure relates generally to a corner segment mountable on a ground engaging tool. The present disclosure also relates to a corner shroud mountable to the corner segment.

BACKGROUND

A work implement, such as a bucket, is mounted to a machine and used to dig into and to move materials, such as sand, gravel, stone, soil, or debris. The bucket may have a ground engaging tool (GET) mounted to an edge of the bucket. The GET engages with the materials to protect the edge of the bucket from wear and, therefore, prolongs the life of the bucket. Over time, accelerated wear may occur on only some portions of the GET, such as corner portions. As a result, the life of the GET is reduced to a life of the portion subjected to accelerated wear. Replacement of the GET is costly due to the expense of a new GET, downtime during replacement, and the effort and expense associated with the replacement process.

The GET may include a plurality of replaceable wear members, also referred to as shrouds, that can be installed separately on the bucket. The shrouds are easier to replace than the entire GET, and, by virtue of replacement of the shrouds, the overall life of the GET and of the bucket may be prolonged. Known shrouds, however, such as the corner tooth assembly described in U.S. Pat. No. 4,047,312, are configured to have planar horizontal and vertical surfaces that are mounted to planar horizontal and vertical surfaces of the bucket. That is, as described in the '312 patent, a corner tooth assembly, as an example of a corner segment, may be removably secured to the corner of a bucket, is bolted to a horizontal floor of the bucket, and thereby fills a gap between the horizontal floor and a vertical side wall member. The corner tooth assembly of the '312 patent, however, may be subjected to excessive wear. In particular, as a horizontal and transversely extending bottom plate of the corner tooth assembly wears, the horizontal floor of the bucket is liable to wear, as well, if the corner tooth assembly is not replaced in a timely manner. Moreover, the corner tooth assembly itself may be subject to uneven wear, with accelerated wear occurring on an outermost portion of the bottom plate. The corner tooth assembly may, therefore, require replacement with a relatively greater frequency, which increases downtime of the machine.

The corner segment and the corner shroud of the present disclosure may solve one or more of the problems set forth above and/or other problems in the art. The scope of the current disclosure, however, is defined by the attached claims, and not by the ability to solve any specific problem.

SUMMARY

In one aspect of the present disclosure, a corner shroud includes a body that may have a floor portion having a floor rear surface, a floor inner surface, a floor lower surface, and a floor upper surface having a curved portion. The body may also have a side portion, extending from the floor portion, and having a side outer surface, a side rear surface, a side inner surface, and a side upper surface. In addition, the body may have a front portion extending between the floor portion and the side portion, the front portion having a front surface, a front inner surface, and a front rear surface. Further, the body may have a top portion extending from the front portion, the top portion having a top upper surface, a top inner surface, a top lower surface, a top rear surface, and a top outer surface. The floor upper surface, the side inner surface, the front rear surface, the top lower surface, and the top inner surface define a recess.

In another aspect of the present disclosure, a corner shroud includes a body that may have a floor portion having a floor lower surface, a floor rear surface, a floor inner surface, and a floor upper surface, the floor upper surface having a curved portion. A thickness of the floor portion increases from an inner end to an outer end thereof along the curved portion. The body may also have a side portion, extending from the floor portion, and having a side outer surface, a side rear surface, a side inner surface adjacent to the curved portion of the floor upper surface, and a side upper surface. In addition, the body may have a front portion extending between the floor portion and the side portion, the front portion having a front surface, a front rear surface, and a front inner surface adjacent to the curved portion of the floor upper surface. Further, the floor portion may have a top portion extending from the front portion, the top portion having a top upper surface, a top inner surface, a top lower surface, a top rear surface, and a top outer surface. The floor upper surface, the side inner surface, the front rear surface, the top lower surface, and the top inner surface define a recess.

In yet another aspect of the present disclosure, a bucket corner includes a body that may include a floor portion having a floor rear surface, a floor inner surface, a floor upper surface, a floor front surface, and a floor lower surface. The body may also include a side portion, extending from an outer end of the floor portion, and having a side front surface, a side outer surface, a side rear surface, a side upper surface, a side inner surface adjacent to the floor upper surface. With respect to a width of the floor portion, the floor portion includes a curved portion adjacent to the side portion.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion, such that a process, method, article, or apparatus that comprises a list of elements does not include only those elements, but may include other elements not expressly listed or inherent to such a process, method, article, or apparatus. In addition, in this disclosure, relative terms, such as, for example, "about," "generally, "substantially," and "approximately" are used to indicate a possible variation of ±10% in the stated value. Further, in this disclosure, references to widths, depths, and heights provided with respect to various portions and/or surfaces are consistent, i.e., all widths are defined along an x-axis, all depths are defined along a z-axis, and all heights are defined along a y-axis.

Figure 1:
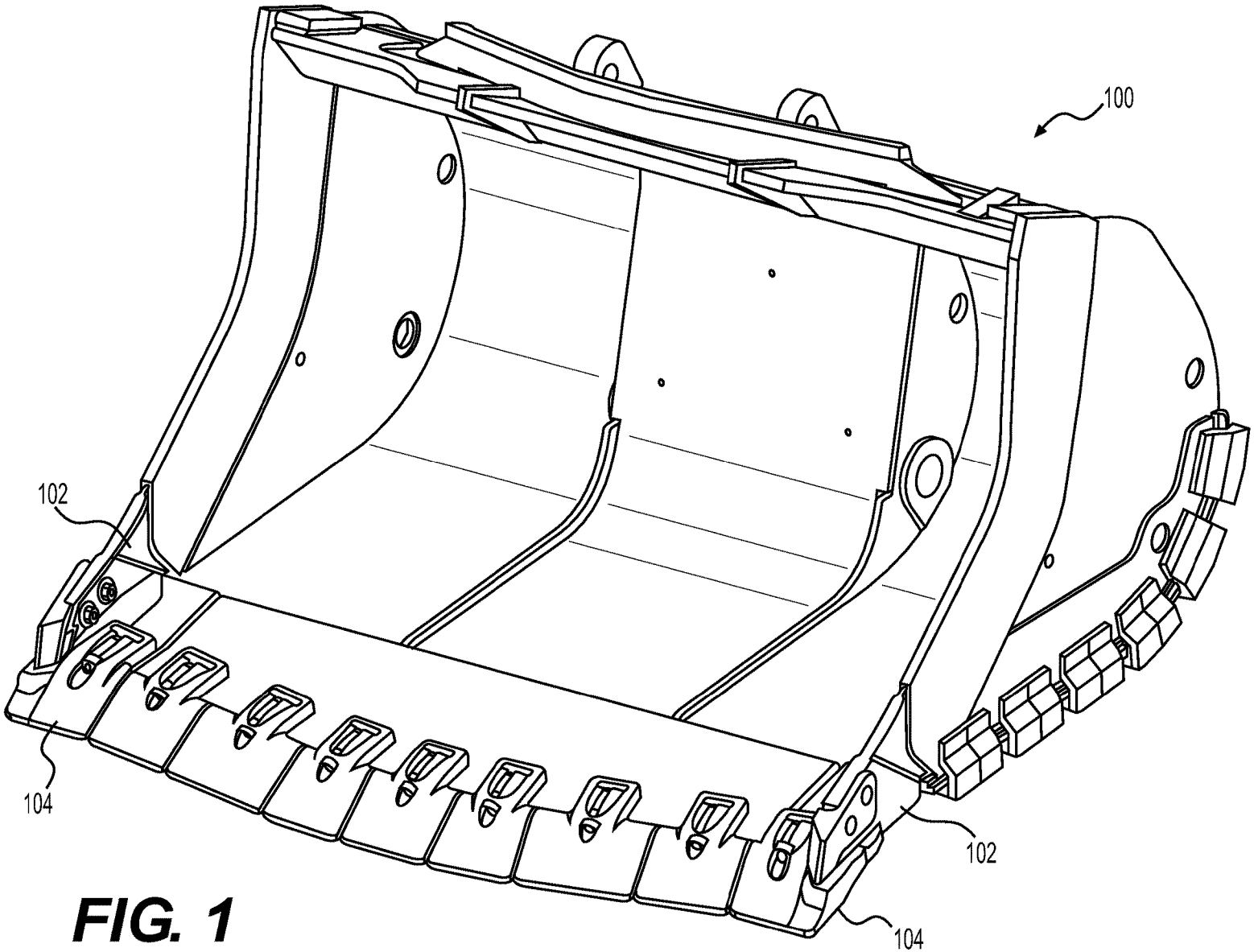
FIG. 1 shows a schematic view of a bucket, as an example of a work implement, having corner segments as portions of a GET, in accordance with the present disclosure.

FIG. 1 shows a schematic view of a bucket 100, as an example of a work implement, of a wheel loader machine, having two corner segments 102, and two corner shrouds 104, as portions of a ground engaging tool (GET) mounted to the bucket 100. The corner segments 102 are attached to corners of the bucket 100, and the corner shrouds 104 are mounted to the corner segments 102. Some surfaces of the corner shrouds 104 are exposed and engage with a material, e.g., sand, gravel, stone, soil, debris, or a combination thereof, while other surfaces of the corner shrouds 104 are in contact with and/or joined with surfaces of the corner segment 102. Both the corner segments 102 and the corner shrouds 104 may be formed of steel, for example. The material that forms the corner segments 102 and the corner shrouds 104 is not, however, limited to steel, and other materials may be used.

Figure 2:
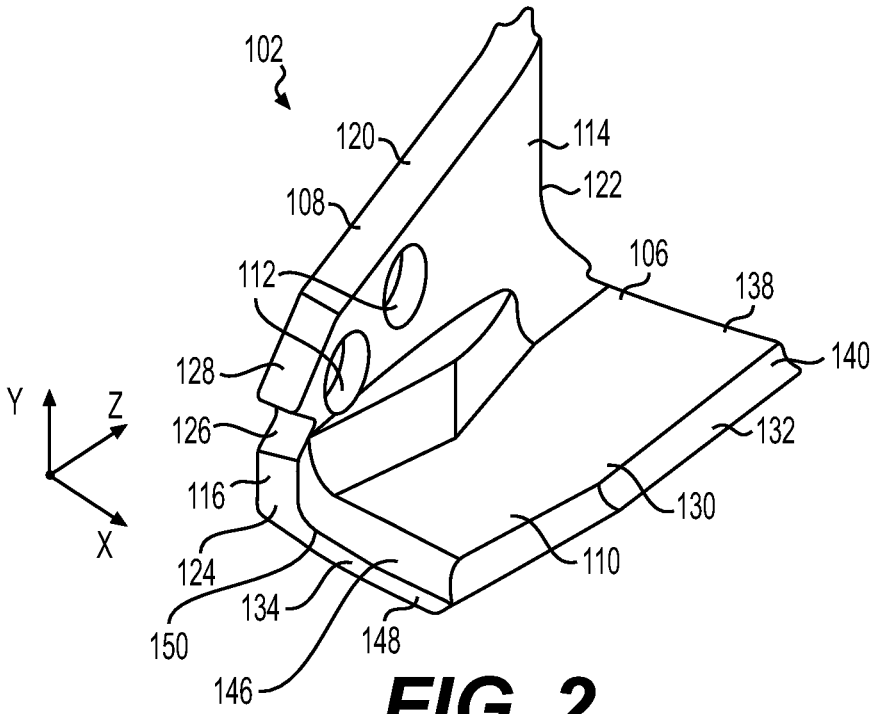
FIG. 2 shows a schematic isometric view of one of the corner segments shown in FIG. 1.
Figure 3:
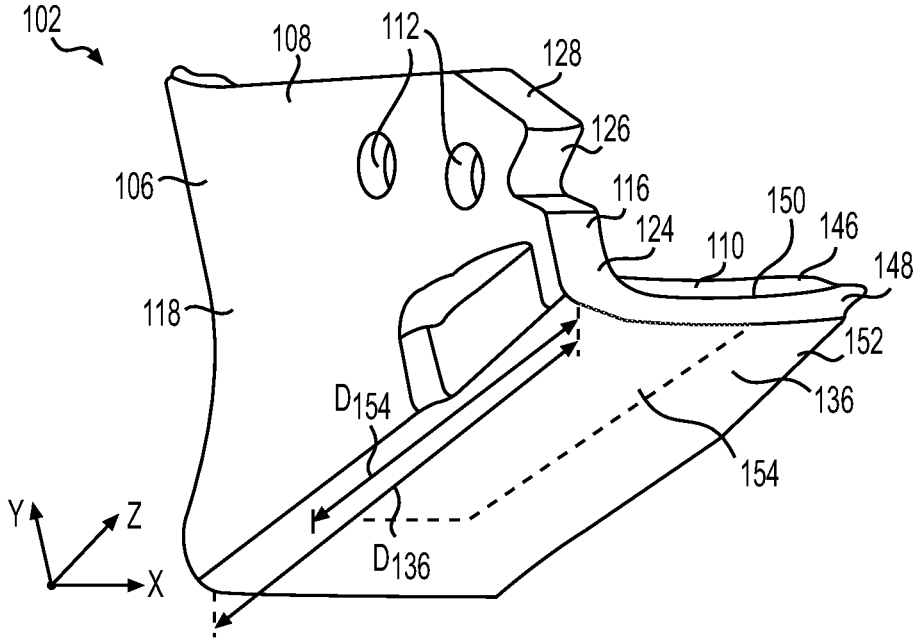
FIG. 3 shows another schematic isometric view of the corner segment shown in FIG. 2.
Figure 4:
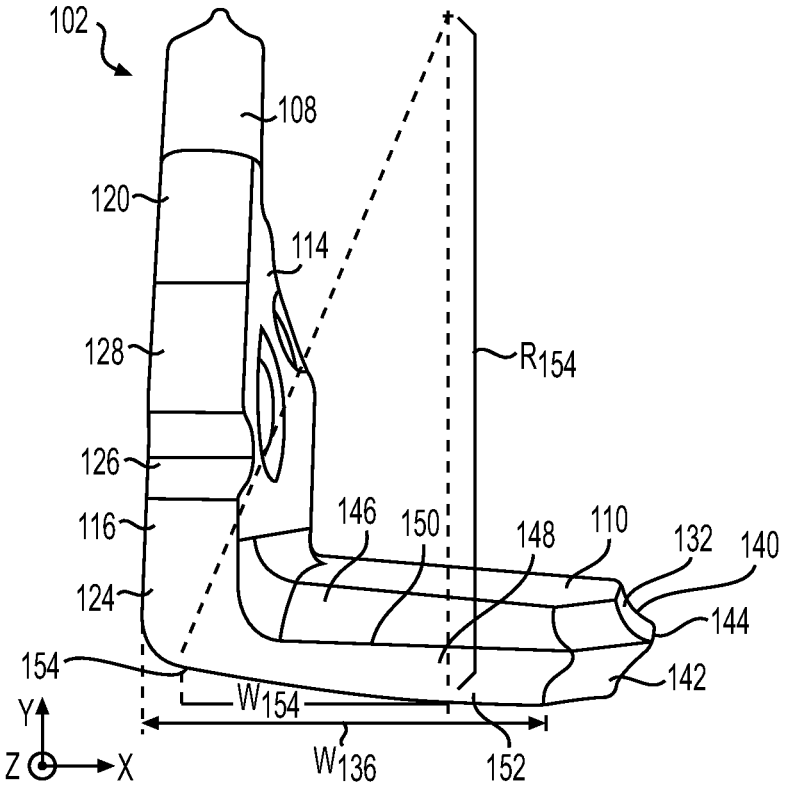
FIG. 4 shows a schematic front view of the corner segment shown in FIGS. 2 and 3.

FIG. 2 shows a schematic isometric view of a corner segment 102, FIG. 3 shows another schematic isometric view of the corner segment 102, and FIG. 4 shows a schematic front view of the corner segment 102. As shown in FIG. 2, the corner segment 102 has a body 106 that includes a side portion 108, which can be secured to the bucket 100, and a floor portion 110 integrally formed with the side portion 108. The side portion 108 may have one or more through-holes 112 configured to receive a lifting member for moving the corner segment 102. With reference to FIGS. 2-4, the side portion 108 has a side inner surface 114, a side front surface 116, a side outer surface 118, a side upper surface 120, and a side rear surface 122. As shown in FIG. 2, the side inner surface 114 may be planar, and may be defined by a height along the y-axis and a depth along the z-axis. The side front surface 116 generally extends perpendicularly to the side inner surface 114, and may include a lower planar surface 124, an indent 126, and an angled surface 128. The side front surface 116 may be defined by a height along the y-axis, and a width along the x-axis. The side upper surface 120 is generally planar, and extends perpendicularly to the side inner surface 114 and at an angle relative to the angled surface 128 of the side front surface 116. The side upper surface 120 may be defined by a width along the x-axis and a depth along the z-axis. The side rear surface 122 extends perpendicularly to the side upper surface 120 and the side inner surface 114, and may be defined by a width along the x-axis and a height along the y-axis. With reference to FIG. 3, the side outer surface 118 is generally planar, and extends perpendicularly to the side front surface 116 and the side upper surface 120. The side outer surface 118 may be defined by a depth along the z-axis, a front end height, adjacent to the front surface, and a rear end height, adjacent to the side rear surface 122, along the y-axis.

With reference to FIGS. 2-4, the floor portion 110 of the corner segment 102 has a floor upper surface 130, a floor inner surface 132, a floor front surface 134, a floor lower surface 136, and a floor rear surface 138. As shown in FIG. 2, the floor upper surface 130 is generally planar and may be defined by a width along the x-axis and a depth along the z-axis. The floor inner surface 132 is generally perpendicular to the floor upper surface 130. As best shown in FIG. 4, and may include an upper chamfered edge 140, a lower chamfered edge 142, and a peak 144 therebetween. The upper chamfered edge 140 is adjacent to the floor upper surface 130, and the lower chamfered edge 142 is adjacent to the floor lower surface 136. The floor inner surface 132 may be defined by a height along the y-axis and a depth along the z-axis. The floor front surface 134 may have an upper chamfered edge 146, a lower chamfered edge 148, and a peak 150 therebetween. The upper chamfered edge 146 is adjacent to the floor upper surface 130, and the lower chamfered edge 148 is adjacent to the floor lower surface 136. The floor front surface 134 is generally perpendicular to the floor inner surface 132, and may be defined by a height along the y-axis and a width along the x-axis. With reference to FIG. 3, the floor lower surface 136 includes a floor planar portion 152 and a curved portion 154. The floor planar portion 152 of the floor lower surface 136 extends perpendicularly to and adjacent to the floor inner surface 132 and the floor front surface 134, forming an L shape around the curved portion 154, as shown in FIG. 3. The floor lower surface 136 may be defined by a width along the x-axis and a depth along the z-axis. The floor rear surface 138 is generally planar, and extends perpendicularly to the floor inner surface 132, the floor upper surface 130, and the floor lower surface 136. The floor rear surface 138 may be defined by a height along the y-axis and a width along the x-axis.

The floor lower surface 136, as shown in FIGS. 3 and 4, is defined by a width $W_{136}$ of the floor portion 110, i.e., along the x-axis, and a depth $D_{136}$ of the floor portion 110, i.e., along the z-axis. The curved portion 154 has a width $W_{154}$ along the x-axis, along a portion of the width $W_{136}$ of the floor lower surface 136 of the floor portion 110, and a depth $D_{154}$ along the z-axis, along a portion of the depth $D_{136}$ of the floor lower surface 136 of the floor portion 110. In the embodiment shown in FIGS. 2-4, the width $W_{154}$ of the curved portion 154 may include approximately two thirds of the width $W_{136}$ of the floor lower surface 136 of the floor portion 110. The width $W_{154}$ of the curved portion 154 is not, however, limited to two thirds of the width $W_{136}$ of the floor lower surface 136 of the floor portion 110, and may include more or less of the width $W_{136}$ of the floor lower surface 136 of the floor portion 110. As an example, the width $W_{136}$ of the floor lower surface 136 of the floor portion 110 may be approximately 225 mm, and the width $W_{154}$ of the curved portion 154 may be approximately 150 mm. The width $W_{136}$ of the floor lower surface 136 of the floor portion 110 and the width $W_{154}$ of the curved portion 154 are not, however, limited to these values. With reference to FIG. 3, a depth $D_{154}$ of the curved portion 154 may include approximately two thirds a depth $D_{136}$ of the floor lower surface 136 of the floor portion 110. The curved portion 154 is defined by a curve at least in the plane defined by the x-axis and the y-axis. A radius of curvature $R_{154}$ of the curve of the curved portion 154, shown in FIG. 4, may be, for example, in a range of 400 mm to 800 mm. The radius of curvature $R_{154}$ is not, however, limited to a value in the range of 400 mm to 800 mm, and may be a value that is less than 400 mm or greater than 800 mm. The value of the radius of curvature $R_{154}$ may also be determined based on one or more dimensions of the corner segment 102, e.g., the width $W_{136}$ of the floor lower surface 136 of the floor portion 110, or the depth $D_{136}$ of the floor lower surface 136 of the floor portion 110.

Figure 5:
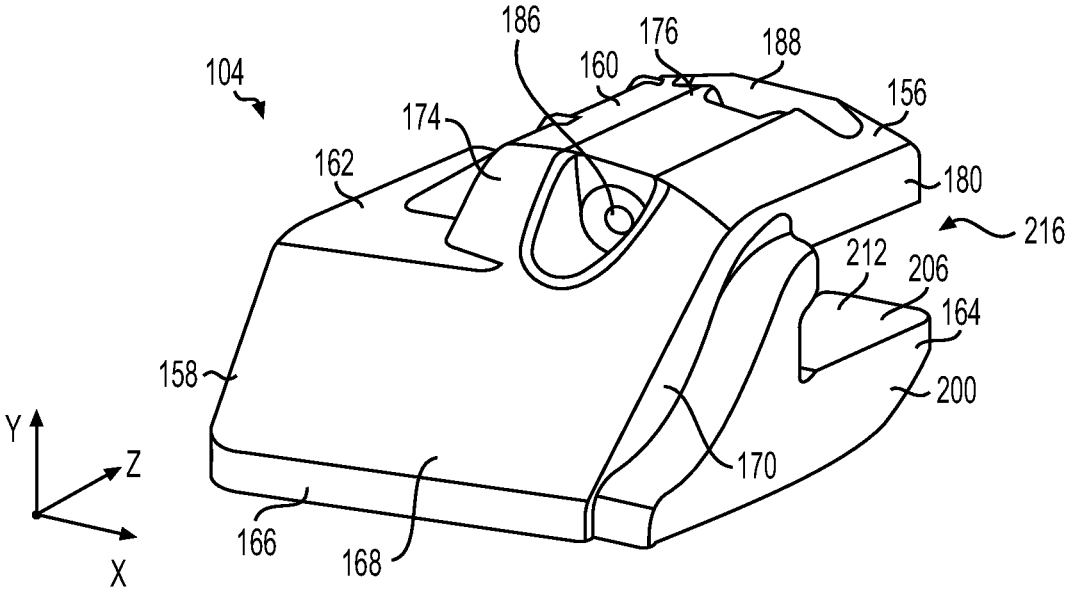
FIG. 5 shows a schematic isometric view of a corner shroud for the corner segment shown in FIGS. 2-4.
Figure 6:
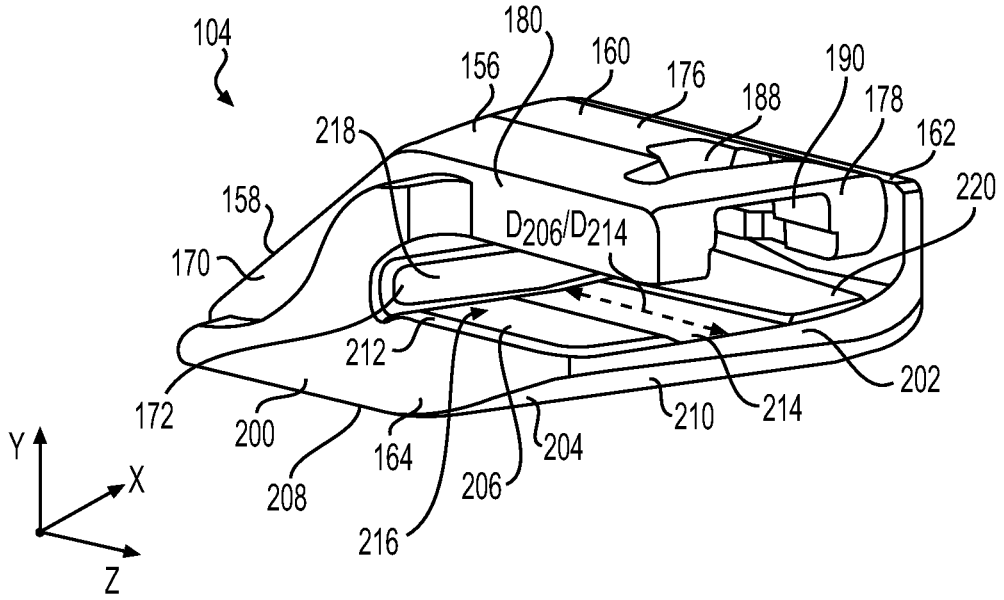
FIG. 6 shows another schematic isometric view of the corner shroud shown in FIG. 5.
Figure 7:
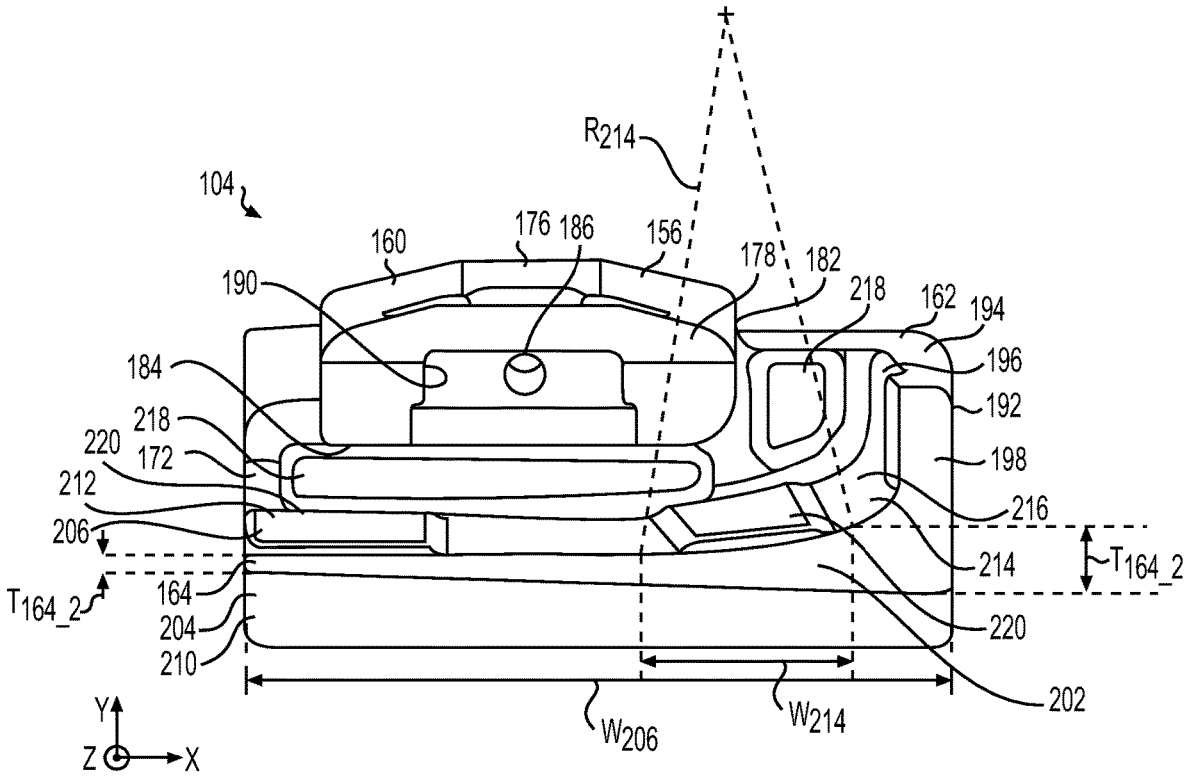
FIG. 7 shows a schematic rear view of the corner shroud shown in FIGS. 5 and 6.

Referring to FIGS. 5-7, the corner shroud 104 has a body 156 that includes a front portion 158, a top portion 160, a side portion 162, and a floor portion 164. With reference to FIGS. 5 and 6, the front portion 158 has a front surface 166, a front upper surface 168, a front inner surface 170, and a front rear surface 172. The front surface 166 is generally rectangular and may be defined by a height along the y-axis and a width along the x-axis. The front upper surface 168 is angled with respect to a plane of the front surface 166, and may be defined by a depth along the z-axis, a width along the x-axis, and a height along the y-axis. The front inner surface 170 extends generally perpendicularly to the front surface 166, and may be defined by a height along the y-axis and a depth along the z-axis. The front rear surface 172 extends generally perpendicularly to the front inner surface 170, and may be defined by a height along the y-axis and a width along the x-axis.

With reference to FIGS. 5-7, the top portion 160 extends from the front portion 158, and has a top front surface 174, a top upper surface 176, a top rear surface 178, a top inner surface 180, a top outer surface 182, and a top lower surface 184. The top front surface 174 is generally planar with a front through-hole 186 extending from the top front surface 174 toward the top rear surface 178. The top front surface 174 may have two planar portions on sides of the front through-hole 186 that extend at an angle relative to a plane of the top upper surface 176. The top front surface 174 may be defined by a height along the y-axis, and a width along the x-axis, for example. The top upper surface 176 is generally planar, and extends at an angle relative to the top front surface 174. The top upper surface 176 may have a top through-hole 188 that extends from the top upper surface 176 to the top lower surface 184. The top upper surface 176 may be defined by a depth along the z-axis and a width along the x-axis, for example. The top rear surface 178 is generally planar, extends perpendicularly to the top upper surface 176, and may be defined by a height along the y-axis and a width along the x-axis. The top inner surface 180 is generally planar, extends perpendicularly to the top upper surface 176 and the top rear surface 178, and may be defined by a depth along the z-axis and a height along the y-axis, for example. The top outer surface 182 is generally planar, extends perpendicularly to the top upper surface 176 and the top rear surface 178, and may be defined by a depth along the z-axis and a height along the y-axis. The top lower surface 184 has a plurality of surfaces that form a notch 190, as shown in FIGS. 6 and 7. In the embodiment shown in FIGS. 6 and 7, the notch 190 is also formed on the top rear surface 178.

As shown in FIGS. 6 and 7, the side portion 162 extends from the front portion 158 and from the floor portion 164, and has a side outer surface 192, a side upper surface 194, a side inner surface 196, and a side rear surface 198. The side outer surface 192 is planar, and may be defined by a height along the y-axis and a depth along the z-axis. The side upper surface 194 is planar, extends perpendicularly from the side outer surface 192, and may be defined by a width along the x-axis and a depth along the z-axis. The side inner surface 196 is generally planar, extends perpendicularly from the side upper surface 194, and may be defined by a height along the y-axis and a depth along the z-axis. The side rear surface 198 is generally planar, extends perpendicularly to the side outer surface 192, the side upper surface 194, and the side inner surface 196, and may be defined by a height along the y-axis and a width along the x-axis.

With reference to FIGS. 6 and 7, the floor portion 164 extends from the front portion 158 and from the side portion 162, and has a floor inner surface 200, a floor rear surface 202, a floor lower surface 204, and a floor upper surface 206. The floor inner surface 200 is generally planar, and is parallel to the front inner surface 170. The floor inner surface 200 may be defined by a depth along the z-axis and a height along the y-axis. The floor rear surface 202 is generally planar, extends perpendicularly to the floor inner surface 200, and may be defined by a height along the y-axis and a width along the x-axis. The floor lower surface 204 may include a planar flat portion 208 adjacent to the front portion 158, and a planar angled portion 210 adjacent to the floor rear surface 202. The planar flat portion 208 and the planar angled portion 210 may form an inner angle of approximately 150°, for example. The floor upper surface 206 extends from the floor inner surface 200 to the side inner surface 196, and from the front rear surface 172 to the floor rear surface 202. The floor upper surface 206 may include a floor planar portion 212 adjacent to the floor inner surface 200. The floor upper surface 206, the side inner surface 196, the front rear surface 172, the top lower surface 184, and the top outer surface 182 define a recess 216.

The floor portion 164 may also have a curved portion 214, as shown in FIGS. 6 and 7, located along a width $W_{206}$ of the floor upper surface 206 of the floor portion 164, i.e., along the x-axis, and a depth $D_{206}$ of the floor upper surface 206 of the floor portion 164, i.e., along the z-axis. The curved portion 214 has a width $W_{214}$ along the x-axis, along a portion of the width $W_{206}$ of the floor upper surface 206, and a depth $D_{214}$ along the z-axis, along a portion of the depth $D_{206}$ of the floor upper surface. In the embodiment shown in FIGS. 5-7, the width $W_{214}$ of the curved portion 214 may include approximately one third of the width $W_{206}$ of the floor upper surface 206. The width $W_{214}$ of the curved portion 214 is not, however, limited to one third of the width $W_{206}$ of the floor upper surface 206, and may encompass more or less of the width $W_{206}$ of the floor upper surface 206. In addition, the width $W_{214}$ of the curved portion 214 may be defined along an outer third of the width $W_{206}$ of the floor upper surface 206, adjacent to a transition or curved corner between the floor upper surface 206 and the side inner surface 196. As an example, the width $W_{206}$ of the floor upper surface 206 may be approximately 300 mm, and the width $W_{214}$ of the curved portion 214 may be approximately 100 mm. The width $W_{206}$ of the floor portion 206 and the width $W_{214}$ of the curved portion 214 are not, however, limited to these values. With reference to FIG. 6, a depth $D_{214}$ of the curved portion 214 may be approximately equal to a depth $D_{206}$ of the floor upper surface 206, and may be approximately 80 mm. The depth $D_{206}$ of the floor upper surface 206 and the depth $D_{214}$ of the curved portion 214 are not, however, limited to these values.

The curved portion 214 is also defined by a curve at least in a plane defined by the x-axis and the y-axis. A radius of curvature $R_{214}$ of the curve of the curved portion 214, as shown in FIG. 7, may be approximately the same as the radius of curvature $R_{154}$ of the curve of the curved portion 154 of the corner segment 102. That is, the radius of curvature $R_{214}$ of the curve of the curved portion 214 may be, for example, in a range of 400 mm to 800 mm. The radius of curvature $R_{214}$ is not, however, limited to a value in the range of 400 mm to 800 mm, and may be a value that is less than 400 mm or greater than 800 mm. The value of the radius of curvature $R_{214}$ may also be determined based on one or more dimensions of the floor upper surface 206 of the corner shroud 104, e.g., the width $W_{206}$ of the floor upper surface 206 of the floor portion 164, or the depth $D_{206}$ of the floor upper surface 206 of the floor portion 164. In addition, by virtue of the curved portion 214, a thickness of the floor portion 164 varies. More specifically, as shown in FIG. 7, the floor portion 164 has an inner end thickness $T_{164_1}$, along the y-axis, at an end adjacent to the floor inner surface 200, and increases toward side inner surface 196, to an outer end thickness $T_{164_2}$, along the y-axis, at an end adjacent to the side inner surface 196. The thickness of the floor portion 164 increases gradually from the inner end thickness $T_{164_1}$ to the outer end thickness $T_{164_2}$. That is, from an inner end of the floor portion 164 to the outer end of the floor portion 164, an amount of material that forms the floor portion 164 of the corner shroud 104 increases. A ratio of the inner end thickness $T_{164_1}$ to the outer end thickness $T_{164_2}$ may be in a range of 110% to 190%, for example. The ratio of thicknesses is not, however, limited to this range, and may be greater than 190% or less than 110%. The radius of curvature $R_{214}$ may also be greater than a radius of curvature of the curved corner between the floor upper surface 206 and the side inner surface 196.

The front portion 158 may have one or more contact pads 218 provided on the front rear surface 172, and the floor portion 164 may have one or more contact pads 220 provided on the floor upper surface 206, as shown in FIGS. 6 and 7. The contact pads 218 and 220 may be formed as raised portions of the respective surfaces, which protrude into the recess 216, and may be spaced apart from each other, as shown, for example, in FIG. 7. In particular, a contact pad 218 may be provided on the front rear surface 172, protruding into the recess 216 between the top outer surface 182 and the side inner surface 196. A second contact pad 218 may also be provided on the front rear surface 172, protruding into the recess 216 between the top lower surface 184 and the floor upper surface 206. One of the contact pads 220 provided on the floor upper surface 206 may be provided on the curved portion 214. In this case, an upper surface of the contact pad 220 on the curved portion 214 is defined by a radius of curvature that is equal to the radius of curvature $R_{214}$ of the curved portion 214 shown in FIG. 7.

INDUSTRIAL APPLICABILITY

The corner segment 102 and the corner shroud 104 of the present disclosure provide an easily replaceable component for a work implement, such as the bucket 100, and an accompanying wear component for a GET mountable to the bucket 100 that reduces uneven wear and thereby prolongs the overall life of the GET and of the bucket 100. In addition, the corner segment 102 and the corner shroud 104 of the present disclosure may require less frequent replacement as compared to conventional corner segments and corner shrouds.

Figure 8:
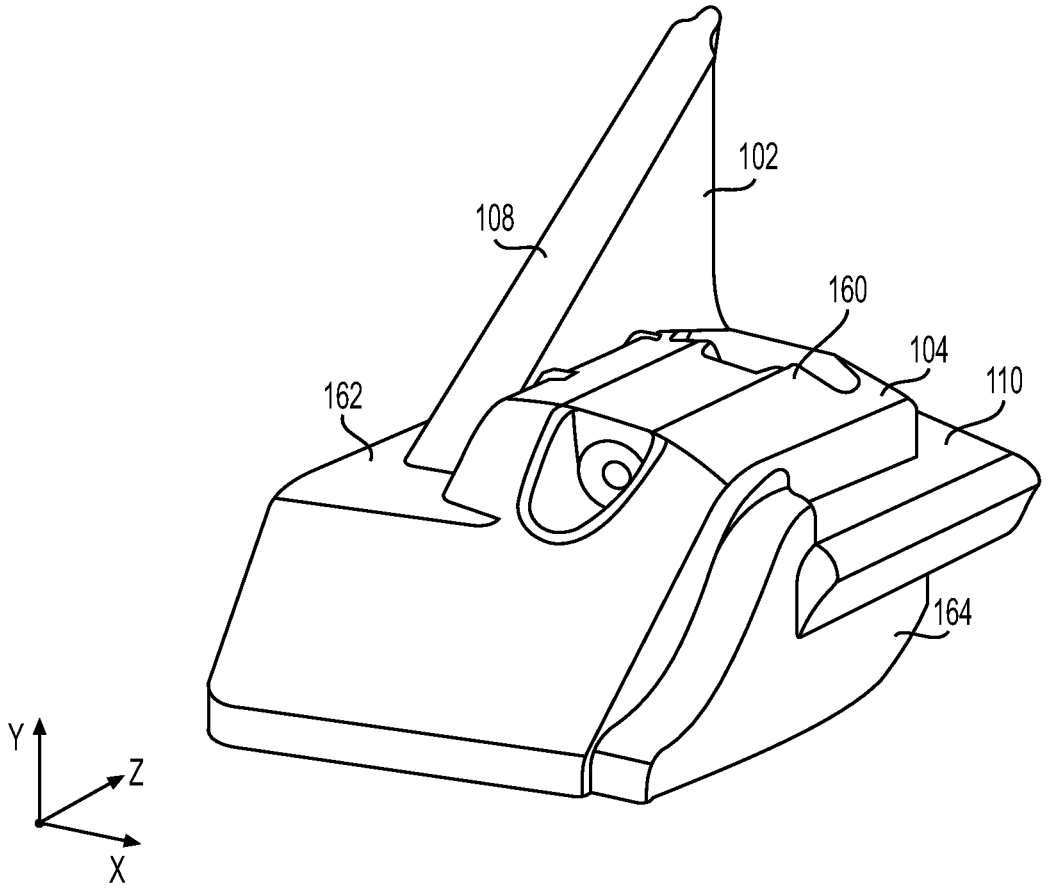
FIG. 8 shows a schematic isometric view of the corner shroud installed on the corner segment.

To mount the corner segment 102 to the bucket 100, the corner segment 102 may be moved by inserting a lift member through one or both of the through-holes 112 in the side portion 108 of the corner segment 102. The corner segment 102 may be secured to the bucket 100 by welding. For example, the side inner surface 114, the side rear surface 122, and the floor rear surface 138 of the corner segment 102 may be welded to the bucket 100. To mount the corner shroud 104 on the corner segment 102, the corner shroud 104 may be moved by inserting a lift member through the top through-hole 188 and the notch 190, and placing/sliding the corner shroud 104 on the corner segment 102. In particular, as shown in FIG. 8, when the corner shroud 104 is placed on the corner segment 102, the floor portion 110 of the corner segment 102 is positioned in the recess 216 between the front portion 158, the top portion 160, the side portion 162, and the floor portion 164 of the corner shroud 104.

More specifically, when the corner shroud 104 is placed on the corner segment 102, the side inner surface 114 of the side portion 108 of the corner segment 102 faces the top outer surface 182 of the top portion 160 of the corner shroud 104, the side outer surface 118 of the side portion 108 of the corner segment 102 faces the side inner surface 196 of the side portion 162 of the corner shroud 104, and the side front surface 116 of the side portion 108 of the corner segment 102 faces the front rear surface 172 of the front portion 158 of the corner shroud 104. In addition, the floor upper surface 130 of the floor portion 110 of the corner segment 102 faces the top lower surface 184 of the top portion 160 of the corner shroud 104, and the floor front surface 134 of the floor portion 110 of the corner segment 102 faces the front rear surface 172 of the front portion 158 of the corner shroud 104, and the floor lower surface 136 of the floor portion 110 of the corner segment 102 faces the floor upper surface 206 of the floor portion 164. In addition, the curved portion 154 of the corner segment 102 is positioned along the curved portion 214 of the corner shroud 104.

The corner segment 102 may be secured to the bucket 100 by, for example, welding. In addition, the corner shroud 104 may be secured to the corner segment 102 by, for example, mechanical means, such as a plurality of bolts and nuts. Alternatively, the corner shroud 104 may be secured to the corner segment 102 by, for example, welding. In particular, one or more of the front rear surface 172, the floor upper surface 206, and the side inner surface 196 of the corner shroud 104 may be welded to the floor upper surface 130, the floor lower surface 136, and the side outer surface 118 of the corner segment 102, respectively, for example. And, more specifically, the floor planar portion 154 of the floor lower surface 136 of the corner segment 102 may be welded to the floor planar portion 212 of the floor upper surface 206 of the corner shroud 104, to ensure a secure welded joint between the corner segment 102 and the corner shroud 104. That is, the floor planar portion 154 of the floor lower surface 136 of the corner segment and the floor planar portion 212 of the floor upper surface 206 of the corner shroud 104 provide flat surfaces for forming square weld joints.

In an alternative embodiment, the curved portion 154 of the corner segment 102 and the curved portion 214 of the corner shroud 104 may be defined by curves in more than one plane. In particular, in addition to being defined by a curve in the plane defined by the x-axis and the y-axis, the curved portions 154 and 214 may also be defined by a curve in the plane defined by the z-axis and the y-axis.

In another alternative embodiment, one or more grooves may be provided on one or more surfaces of the floor portion 164 of the corner shroud 104 for engagement with surfaces of the corner segment 102. In particular, grooves may be provided on one or more of the front rear surface 172, the top outer surface 182, the top lower surface 184, the side inner surface 196, and the floor upper surface 206 of the corner shroud 206, and a corresponding surface of the corner segment 102, i.e., the floor front surface 134, the side inner surface 114, the floor upper surface 130, the side outer surface 118, and the floor lower surface 136, respectively, of the corner segment 102, may engage with the grooves.

In still another alternative embodiment, the radius of curvature $R_{154}$ of the curved portion 154 of the corner segment 102 and the radius of curvature $R_{214}$ of the curved portion 214 of the corner shroud may vary along the width $W_{154}$ of the curved portion 154 and along the width $W_{214}$ of the curved portion 214, respectively. In this embodiment, the curved portion 154 of the corner segment 102 and the curved portion 214 of the corner shroud 104 may have a relatively greater radius of curvature near an inner end thereof, the a relatively lower radius of curvature near an outer end thereof.

By virtue of the increased thickness, i.e., the outer end thickness $T_{164_2}$ of the floor portion 164 at an end adjacent to the side inner surface 196, and, in particular, the additional material on the floor portion 164 of the corner shroud 104, the wear life of the corner shroud 104 is increased. That is, the shape of the corner segment 102 of the present disclosure provides for use of a shroud having a greater amount of material in an area subjected to accelerated wear, as compared to conventional shrouds. And, as a result, the wear life of the corner segment and the wear life of the corner shroud 104 may be increased. Further, downtime of the machine for replacement of one or both of the corner segment 102 and the corner shroud 104 may be reduced.

Further, by virtue of the curved portion 154 of the corner segment 102 nesting within the curved portion 214 of the corner shroud 104, when the floor portion 110 of the corner segment 102 is positioned in the recess 216 of the corner shroud 104, a close fit is formed between the corner segment 102 and the corner shroud 104. In addition, with the floor planar portion 152 of the corner segment 102 and the floor planar portion 212 of the corner shroud 104 being provided for secure attachment of the corner segment 102 and the corner shroud 104, the assembled corner segment 102 and corner shroud 104 are secured without spacing therebetween. This ensures that the corner segment 102 does not move relative to the corner shroud 104 during use, and, therefore, that the welded joint between the corner segment 102 and the corner shroud 104 is not stressed or broken.

It will be apparent to those skilled in the art that various modifications and variations can be made to the disclosed corner segment and corner shroud without departing from the scope of the disclosure. Other embodiments of the corner segment and corner shroud will be apparent to those skilled in the art from consideration of the specification and the accompanying figures. It is intended that the specification, and, in particular, the examples provided herein be considered as exemplary only, with a true scope of the disclosure being indicated by the following claims and their equivalents.

We claim:

1. A corner shroud comprising a body that includes:

a floor portion having a floor rear surface, a floor inner surface, a floor lower surface, and a floor upper surface having a curved portion;

a side portion, extending from the floor portion, and having a side outer surface, a side rear surface, a side inner surface, and a side upper surface;

a front portion extending between the floor portion and the side portion, the front portion having a front surface, a front inner surface, and a front rear surface;

a top portion extending from the front portion, the top portion having a top upper surface, a top inner surface, a top lower surface, a top rear surface, and a top outer surface; and a contact pad forming a raised surface on the curved portion, the contact pad having a first edge on the curved portion and a second edge on the curved portion, wherein the floor upper surface, the side inner surface, the front rear surface, the top lower surface, and the top inner surface define a recess, and a radius of curvature of the curved portion varies from an inner end of the curved portion, closest to the floor inner surface, to an outer end of the curved portion, closest to the side inner surface.

2. The corner shroud of claim 1, wherein the curved portion of the floor upper surface is defined by a curve in a plane defined by a horizontal width of the floor portion and a vertical height of the floor portion.

3. The corner shroud of claim 2, wherein, with respect to the horizontal width of the floor portion, the radius of curvature of the curved portion varies within a range of 400 mm to 800 mm.

4. The corner shroud of claim 2, wherein, with respect to the horizontal width of the floor portion, the curved portion includes an outer half of the floor portion.

5. The corner shroud of claim 2, wherein, with respect to a depth of the floor portion, the curved portion includes an outer two thirds of the floor portion.

6. The corner shroud of claim 1, wherein the contact pad on the curved portion has a curved upper surface.

7. The corner shroud of claim 1, wherein the curved portion is continuously curved from the side inner surface to a location directly below the top lower surface.

8. The corner shroud of claim 1, wherein the contact pad protrudes from the curved portion, as measured from the curved portion in a direction towards the recess.

9. The corner shroud of claim 1, further including an additional contact pad that protrudes into the recess from the front rear surface.

10. A corner shroud comprising a body that includes:

a floor portion having a floor lower surface, a floor rear surface, a floor inner surface, and a floor upper surface, the floor upper surface having a curved portion that is continuously curved, wherein a thickness of the floor portion increases from an inner end to an outer end thereof along the curved portion;

a side portion, extending from the floor portion, and having a side outer surface, a side rear surface, a side inner surface adjacent to the curved portion of the floor upper surface, and a side upper surface;

a front portion extending between the floor portion and the side portion, the front portion having a front surface, a front rear surface, and a front inner surface adjacent to the curved portion of the floor upper surface; and a top portion extending from the front portion, the top portion having a top upper surface, a top inner surface, a top lower surface, a top rear surface, and a top outer surface, wherein the floor upper surface, the side inner surface, the front rear surface, the top lower surface, and the top inner surface define a recess, a protrusion enters the recess from the curved portion, and a radius of curvature of the curved portion varies from an inner end of the curved portion, closest to the floor inner surface, to an outer end of the curved portion, closest to the side inner surface.

11. The corner shroud of claim 10, wherein a ratio of the thickness of the floor portion at the outer end to the thickness of the floor portion at the inner end is in a range of 110% to 190%.

12. The corner shroud of claim 10, wherein the curved portion of the floor upper surface is defined by a curve in a plane defined by a horizontal width of the floor portion and a vertical height of the floor portion.

13. The corner shroud of claim 12, wherein, with respect to the horizontal width of the floor portion, the radius of curvature of the curved portion varies within a range of 400 mm to 800 mm.

14. The corner shroud of claim 12, wherein, with respect to the horizontal width of the floor portion, the curved portion includes an outer half of the floor portion.

15. The corner shroud of claim 12, wherein, with respect to a depth of the floor portion, the curved portion includes an outer two thirds of the floor portion.

16. The corner shroud of claim 10, wherein at least one contact pad is provided on the curved portion, and the at least one contact pad on the curved portion has a curved upper surface.

17. The corner shroud of claim 10, wherein the curved portion is continuously curved from the side inner surface to a location directly below the top lower surface.

18. The corner shroud of claim 10, wherein the protrusion is a contact pad that protrudes from the curved portion, as measured in a direction from the curved portion towards the recess.

* * * * *